US007854431B1

(12) United States Patent
Barnwell

(10) Patent No.: US 7,854,431 B1
(45) Date of Patent: Dec. 21, 2010

(54) TABLE BINGO GAME

(76) Inventor: William Barnwell, 195 Woodland Cir., Piedmont, AL (US) 36272

( * ) Notice: Subject to any disclaimer, the term of this patent is extended or adjusted under 35 U.S.C. 154(b) by 0 days.

(21) Appl. No.: 12/576,854

(22) Filed: Oct. 9, 2009

(51) Int. Cl.
*A63F 1/00* (2006.01)

(52) U.S. Cl. ..... 273/269

(58) Field of Classification Search ..... 273/269; 463/19

See application file for complete search history.

(56) References Cited

U.S. PATENT DOCUMENTS

| | | | | |
|---|---|---|---|---|
| 1,655,380 | A | 1/1928 | Parker | |
| 4,252,322 | A | 2/1981 | Orter | |
| 5,127,656 | A | 7/1992 | Simpson | |
| 5,265,880 | A | 11/1993 | Maksymec | |
| 5,727,786 | A | 3/1998 | Weingardt | |
| 5,823,534 | A | 10/1998 | Banyai | |
| 6,079,711 | A | 6/2000 | Wei et al. | |
| 6,382,629 | B1 * | 5/2002 | Hill | 273/303 |
| 6,656,044 | B1 | 12/2003 | Lewis | |
| 6,755,738 | B2 * | 6/2004 | Glasson et al. | 463/19 |
| 6,916,242 | B1 * | 7/2005 | Takeyama et al. | 463/20 |
| 7,614,948 | B2 * | 11/2009 | Saffari et al. | 463/19 |
| 7,666,084 | B2 * | 2/2010 | Herrmann et al. | 463/19 |
| 7,717,785 | B2 * | 5/2010 | Odom | 463/19 |
| 7,727,064 | B1 * | 6/2010 | Luciano, Jr. | 463/19 |

OTHER PUBLICATIONS

"Bingo_US", website: http://en.wikipedia.org/wiki/Bingo_(U.S.); printed Jun. 28, 2009; 7 pages.

* cited by examiner

*Primary Examiner*—William M Pierce
(74) *Attorney, Agent, or Firm*—Christopher Wood; Premier Law Group

(57) ABSTRACT

A table bingo game. The table bingo game is played by one to n players and makes use of a table having a table surface and a table grid marked out on the table surface. The table grid comprises m rows and n columns to provide an m by n matrix defining a rectangular array of preselected numbers therein. Each number in the m by n matrix has an integer value between 1 and y. A deck of bingo cards is provided having integer numbers printed thereon. A set of n player cards is provided each having a player grid printed thereon with four corner numbers. For each set of four corner numbers there is a column in the table grid having four matching numbers. The winner is the player with a player card that matches a column on the grid four matching bingo cards laid out thereon.

4 Claims, 17 Drawing Sheets

280a

160a

| B | I | N | G | O |
|---|---|---|---|---|
| 6 | 30 | 32 | 54 | 66 |
| 10 | 25 | 40 | 60 | 70 |
| 13 | 17 | FREE | 47 | 71 |
| 12 | 22 | 31 | 48 | 68 |
| 7 | 23 | 33 | 55 | 67 |

FIG. 5

280b

160b

| B | I | N | G | O |
|---|---|---|---|---|
| 5 | 25 | 39 | 57 | 65 |
| 7 | 17 | 45 | 52 | 68 |
| 13 | 16 | FREE | 53 | 70 |
| 10 | 30 | 32 | 46 | 64 |
| 15 | 22 | 36 | 60 | 75 |

FIG. 6

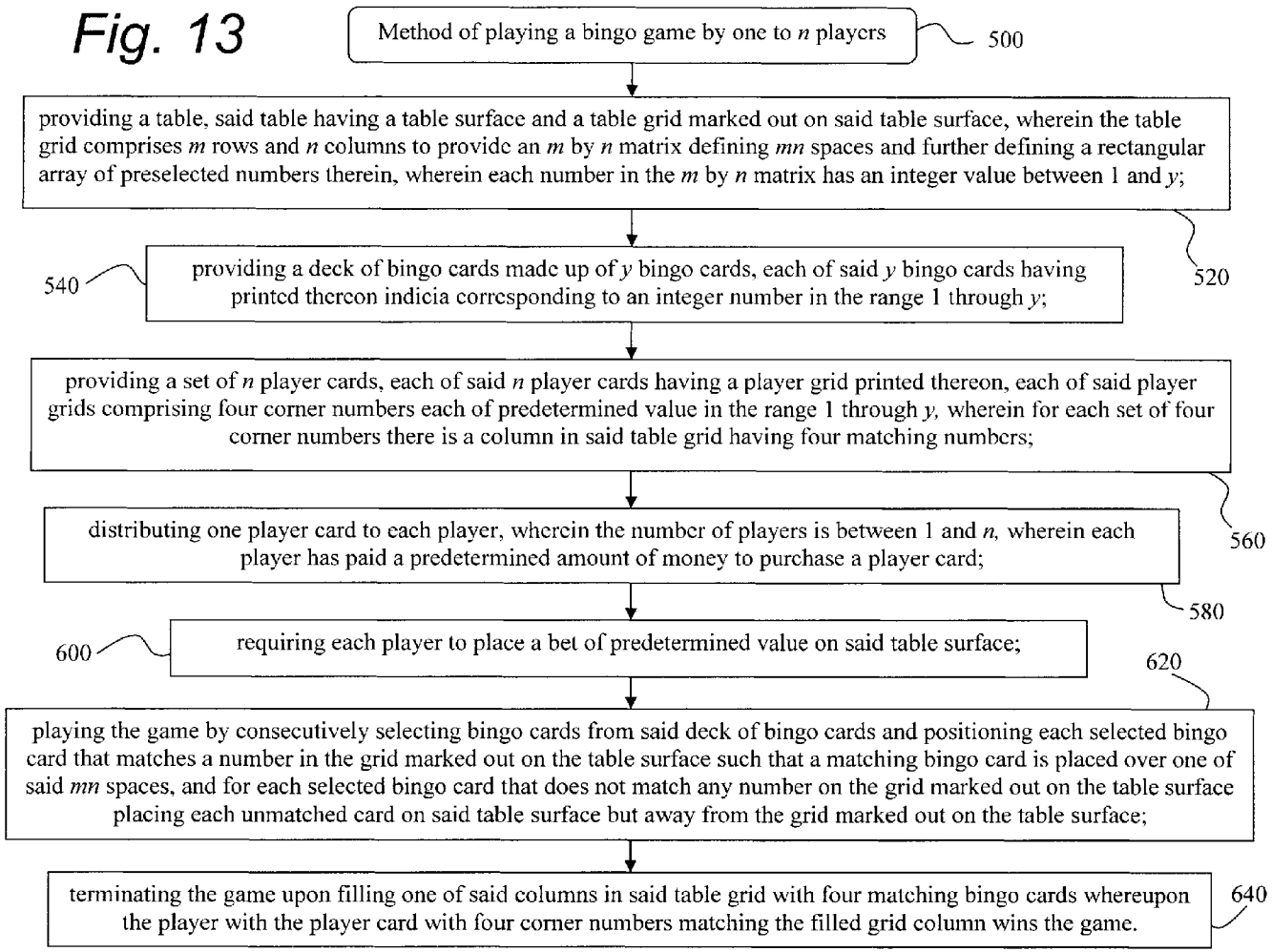
Fig. 13
Method of playing a bingo game by one to n players
500
providing a table, said table having a table surface and a table grid marked out on said table surface, wherein the table grid comprises m rows and n columns to provide an m by n matrix defining mn spaces and further defining a rectangular array of preselected numbers therein, wherein each number in the m by n matrix has an integer value between 1 and y;
520
providing a deck of bingo cards made up of y bingo cards, each of said y bingo cards having printed thereon indicia corresponding to an integer number in the range 1 through y;
540
providing a set of n player cards, each of said n player cards having a player grid printed thereon, each of said player grids comprising four corner numbers each of predetermined value in the range 1 through y, wherein for each set of four corner numbers there is a column in said table grid having four matching numbers;
560
distributing one player card to each player, wherein the number of players is between 1 and n, wherein each player has paid a predetermined amount of money to purchase a player card;
580
requiring each player to place a bet of predetermined value on said table surface;
600
playing the game by consecutively selecting bingo cards from said deck of bingo cards and positioning each selected bingo card that matches a number in the grid marked out on the table surface such that a matching bingo card is placed over one of said mn spaces, and for each selected bingo card that does not match any number on the grid marked out on the table surface placing each unmatched card on said table surface but away from the grid marked out on the table surface;
620
terminating the game upon filling one of said columns in said table grid with four matching bingo cards whereupon the player with the player card with four corner numbers matching the filled grid column wins the game.
640

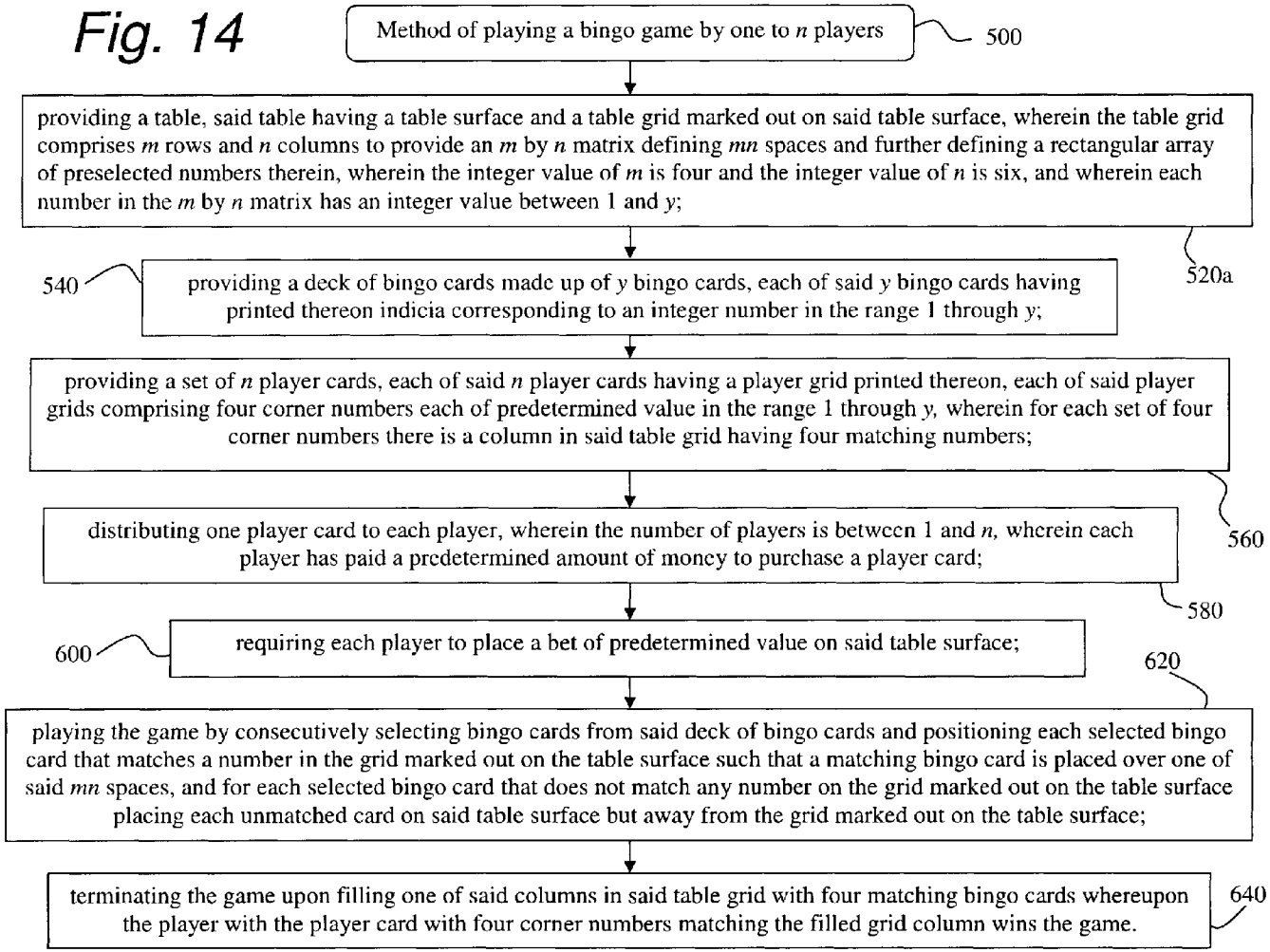
Fig. 14
Method of playing a bingo game by one to n players
500
providing a table, said table having a table surface and a table grid marked out on said table surface, wherein the table grid comprises m rows and n columns to provide an m by n matrix defining mn spaces and further defining a rectangular array of preselected numbers therein, wherein the integer value of m is four and the integer value of n is six, and wherein each number in the m by n matrix has an integer value between 1 and y;
520a
540
providing a deck of bingo cards made up of y bingo cards, each of said y bingo cards having printed thereon indicia corresponding to an integer number in the range 1 through y;
providing a set of n player cards, each of said n player cards having a player grid printed thereon, each of said player grids comprising four corner numbers each of predetermined value in the range 1 through y, wherein for each set of four corner numbers there is a column in said table grid having four matching numbers;
560
distributing one player card to each player, wherein the number of players is between 1 and n, wherein each player has paid a predetermined amount of money to purchase a player card;
580
requiring each player to place a bet of predetermined value on said table surface;
600
620
playing the game by consecutively selecting bingo cards from said deck of bingo cards and positioning each selected bingo card that matches a number in the grid marked out on the table surface such that a matching bingo card is placed over one of said mn spaces, and for each selected bingo card that does not match any number on the grid marked out on the table surface placing each unmatched card on said table surface but away from the grid marked out on the table surface;
640
terminating the game upon filling one of said columns in said table grid with four matching bingo cards whereupon the player with the player card with four corner numbers matching the filled grid column wins the game.

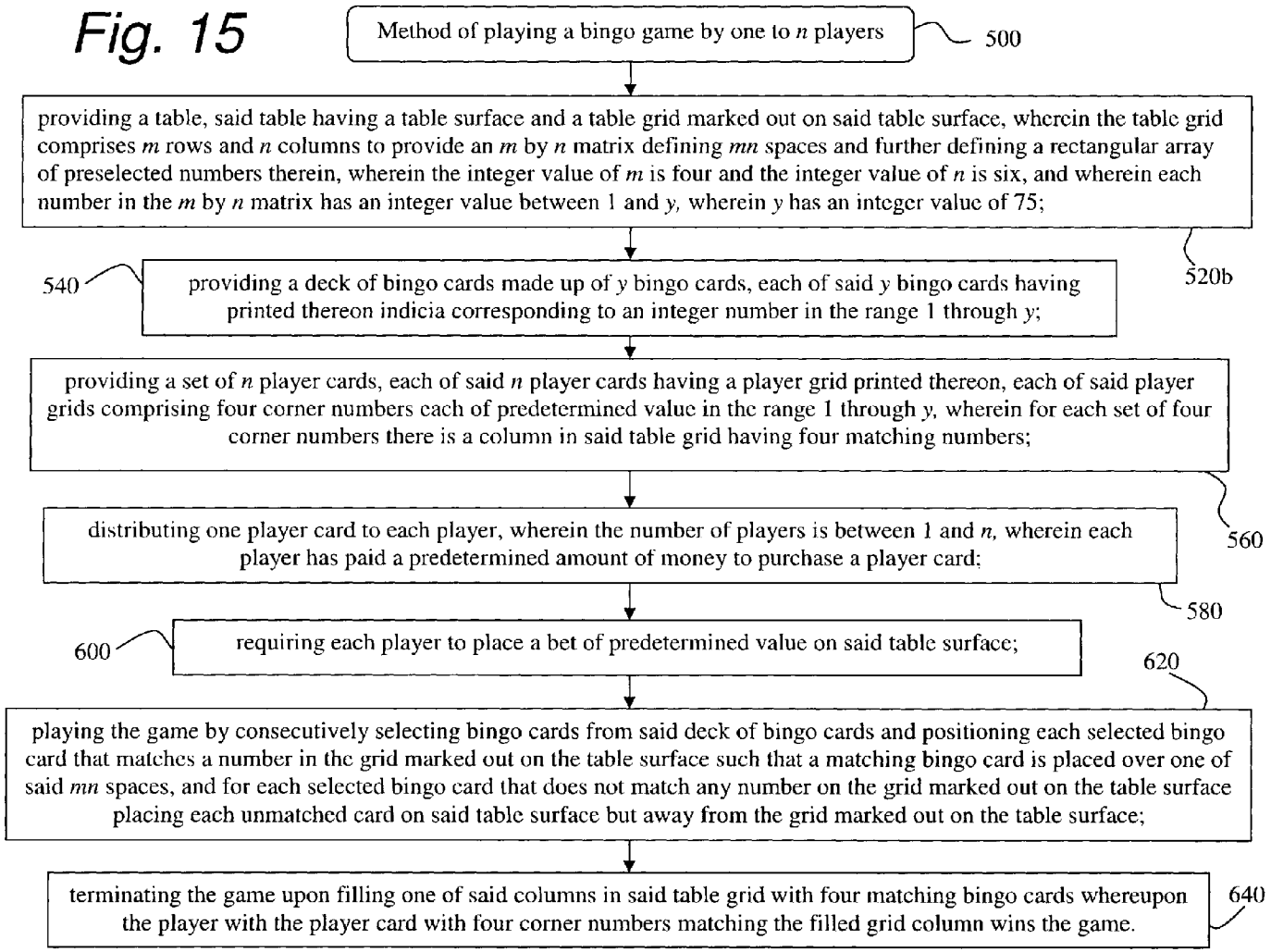
Fig. 15
Method of playing a bingo game by one to n players
500
providing a table, said table having a table surface and a table grid marked out on said table surface, wherein the table grid comprises m rows and n columns to provide an m by n matrix defining mn spaces and further defining a rectangular array of preselected numbers therein, wherein the integer value of m is four and the integer value of n is six, and wherein each number in the m by n matrix has an integer value between 1 and y, wherein y has an integer value of 75;
520b
providing a deck of bingo cards made up of y bingo cards, each of said y bingo cards having printed thereon indicia corresponding to an integer number in the range 1 through y;
540
providing a set of n player cards, each of said n player cards having a player grid printed thereon, each of said player grids comprising four corner numbers each of predetermined value in the range 1 through y, wherein for each set of four corner numbers there is a column in said table grid having four matching numbers;
560
distributing one player card to each player, wherein the number of players is between 1 and n, wherein each player has paid a predetermined amount of money to purchase a player card;
580
requiring each player to place a bet of predetermined value on said table surface;
600
playing the game by consecutively selecting bingo cards from said deck of bingo cards and positioning each selected bingo card that matches a number in the grid marked out on the table surface such that a matching bingo card is placed over one of said mn spaces, and for each selected bingo card that does not match any number on the grid marked out on the table surface placing each unmatched card on said table surface but away from the grid marked out on the table surface;
620
terminating the game upon filling one of said columns in said table grid with four matching bingo cards whereupon the player with the player card with four corner numbers matching the filled grid column wins the game.
640

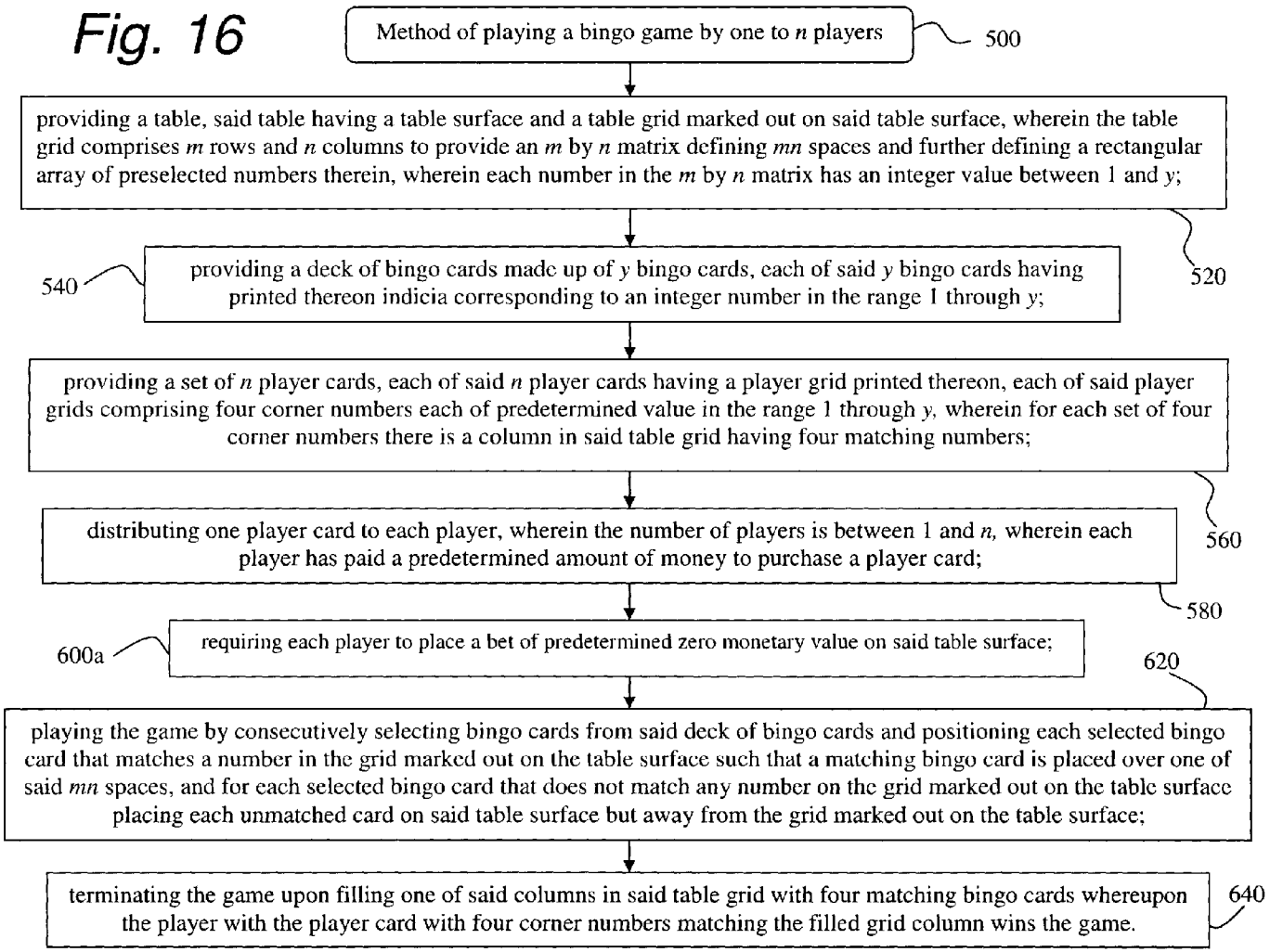
Fig. 16
Method of playing a bingo game by one to n players
500
providing a table, said table having a table surface and a table grid marked out on said table surface, wherein the table grid comprises m rows and n columns to provide an m by n matrix defining mn spaces and further defining a rectangular array of preselected numbers therein, wherein each number in the m by n matrix has an integer value between 1 and y;
520
providing a deck of bingo cards made up of y bingo cards, each of said y bingo cards having printed thereon indicia corresponding to an integer number in the range 1 through y;
540
providing a set of n player cards, each of said n player cards having a player grid printed thereon, each of said player grids comprising four corner numbers each of predetermined value in the range 1 through y, wherein for each set of four corner numbers there is a column in said table grid having four matching numbers;
560
distributing one player card to each player, wherein the number of players is between 1 and n, wherein each player has paid a predetermined amount of money to purchase a player card;
580
requiring each player to place a bet of predetermined zero monetary value on said table surface;
600a
620
playing the game by consecutively selecting bingo cards from said deck of bingo cards and positioning each selected bingo card that matches a number in the grid marked out on the table surface such that a matching bingo card is placed over one of said mn spaces, and for each selected bingo card that does not match any number on the grid marked out on the table surface placing each unmatched card on said table surface but away from the grid marked out on the table surface;
640
terminating the game upon filling one of said columns in said table grid with four matching bingo cards whereupon the player with the player card with four corner numbers matching the filled grid column wins the game.

TABLE BINGO GAME

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

This invention relates generally to card games. More specifically, the invention is a table bingo game.

BACKGROUND OF THE INVENTION

As noted in U.S. Pat. No. 5,265,880, Bingo is typically played using a bingo card which contains twenty-five numbered squares laid out in a 5 by 5 grid. Each of the five vertical rows is centered under the letters B-I-N-G-O; seventy-five or ninety numbers are used, with numbers 1-15 being assigned to the first or "B" row, 16-30 to the "I" row, etc. The central square on the bingo card is a typically a free number and is covered by a marker at the beginning of the game.

Winning numbers are typically selected from the group 1-75 or 1-90 by any of many random selection means. As each winning number is drawn, the player scans the card to determine if the number appears on his card, and covers the number if it does appear. The first player to achieve five markers in a row on the card is declared a winner. Historically, bingo has been played as a parlor game, in movie theaters, for church and charity fundraisers, and as a gambling game in licensed casinos.

U.S. Pat. No. 5,823,534 describes a bingo game played by a plurality of players employing a table having respective player stations thereabout. The game permits each player to select each of his or her numbers to be matched during play by randomly drawn numbers, including a wild designation which each player may deem to match one of his or her selected numbers, and the game is permitted to progress at multiple levels of play notwithstanding the occurrence of prior bingos in the game being played.

U.S. Pat. No. 5,265,880 discloses a "blackout" or "cover-all" bingo game is played over a long duration, e.g., 24 hours. A fixed number (48-58) of bingo numbers are drawn from the pool of numbers at the beginning of the game and are posted or displayed for players to see. Players may acquire cards at any time during the play of the game and compare the cards with the winning numbers to see if the card is a winning card. Winning cards are paid off at a minimum of 1,000 times the purchase price. The card faces are invisible to the player upon purchase, and can be preprinted, printed by a random generator on demand, or be displayed on video screens.

None of the above inventions and patents, taken either singly or in combination, is seen to describe the instant invention as claimed.

BRIEF DESCRIPTION OF THE DRAWINGS

FIGS. 5 through 10 show an example set of player cards.

FIGS. 13 through 16 each show a flowchart in accordance with the invention.

SUMMARY OF THE INVENTION

A table bingo game. The table bingo game is played by one to n players and makes use of a table having a table surface and a table grid marked out on the table surface. The table grid comprises m rows and n columns to provide an m by n matrix defining a rectangular array of preselected numbers therein. Each number in the m by n matrix has an integer value between 1 and y. A deck of bingo cards is provided having integer numbers printed thereon. A set of n player cards is provided each having a player grid printed thereon with four corner numbers. For each set of four corner numbers there is a column in the table grid having four matching numbers. The winner is the player with a player card that matches a column on the grid four matching bingo cards laid out thereon.

DETAILED DESCRIPTION OF THE INVENTION

This invention is directed to a table bingo game. The table bingo game of the invention is denoted generally by the numeric label "100".

It should be understood that the term "predetermined bet" refers to bets of either predetermined monetary value or no monetary value. For example, players may be required to put down six U.S. dollars in cash or chips of equivalent value. Alternatively, the bets of predetermined value include, for example: chips, counters, tokens of zero monetary value. Thus, the table bingo game of the present invention is a game that can be played without using or winning money wherein by not playing to win money the object simply becomes playing to win the game much like a game of "snakes and ladders" (also known as "chutes and ladders"), i.e., the present invention can be played without money using, e.g., counters or tokens of zero monetary value.

Figure 1:
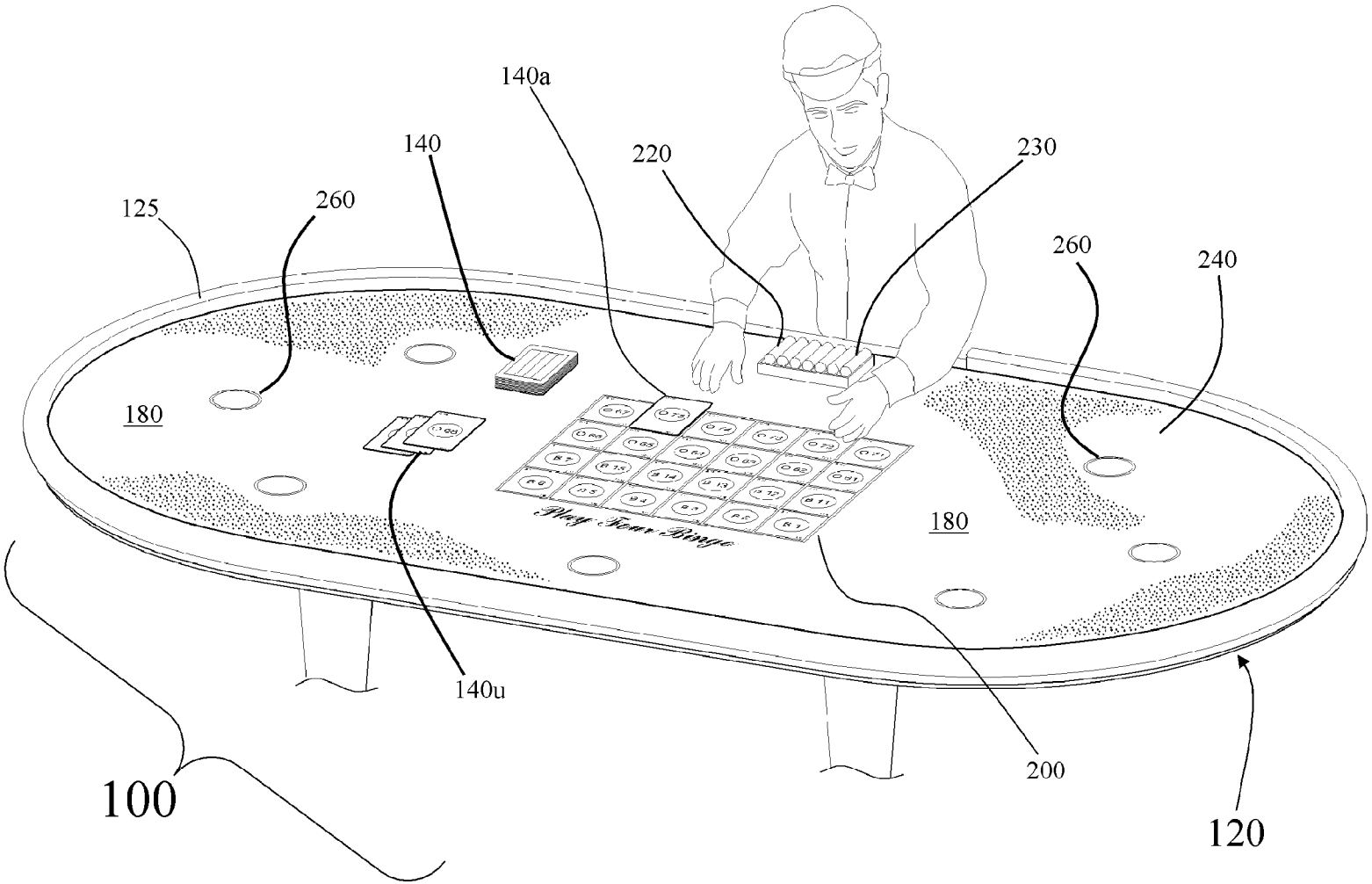
FIGS. 1 through 4B show various views of a bingo table setup according to the present invention.
Figure 2:
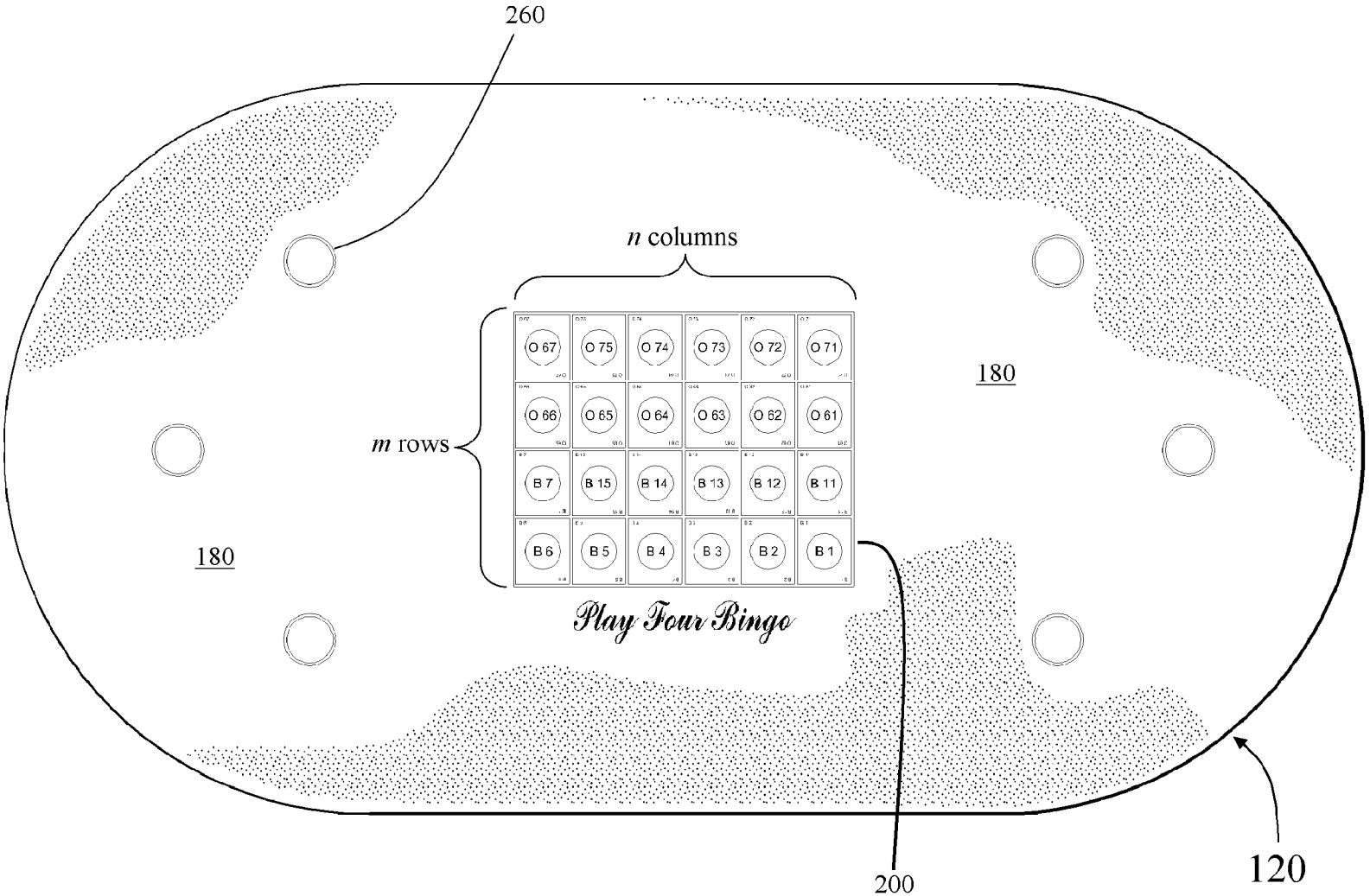
Figure 3:
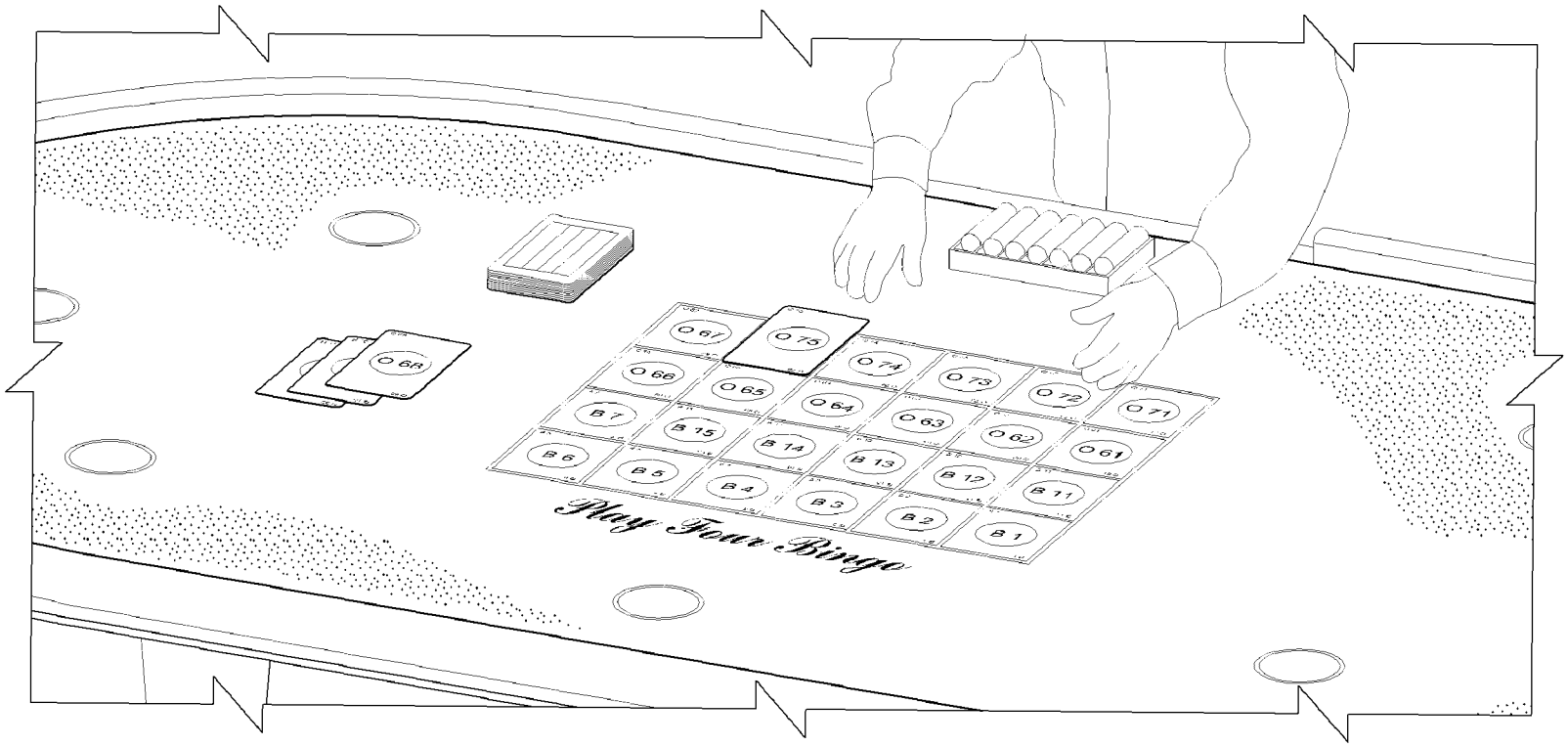
Figure 11:
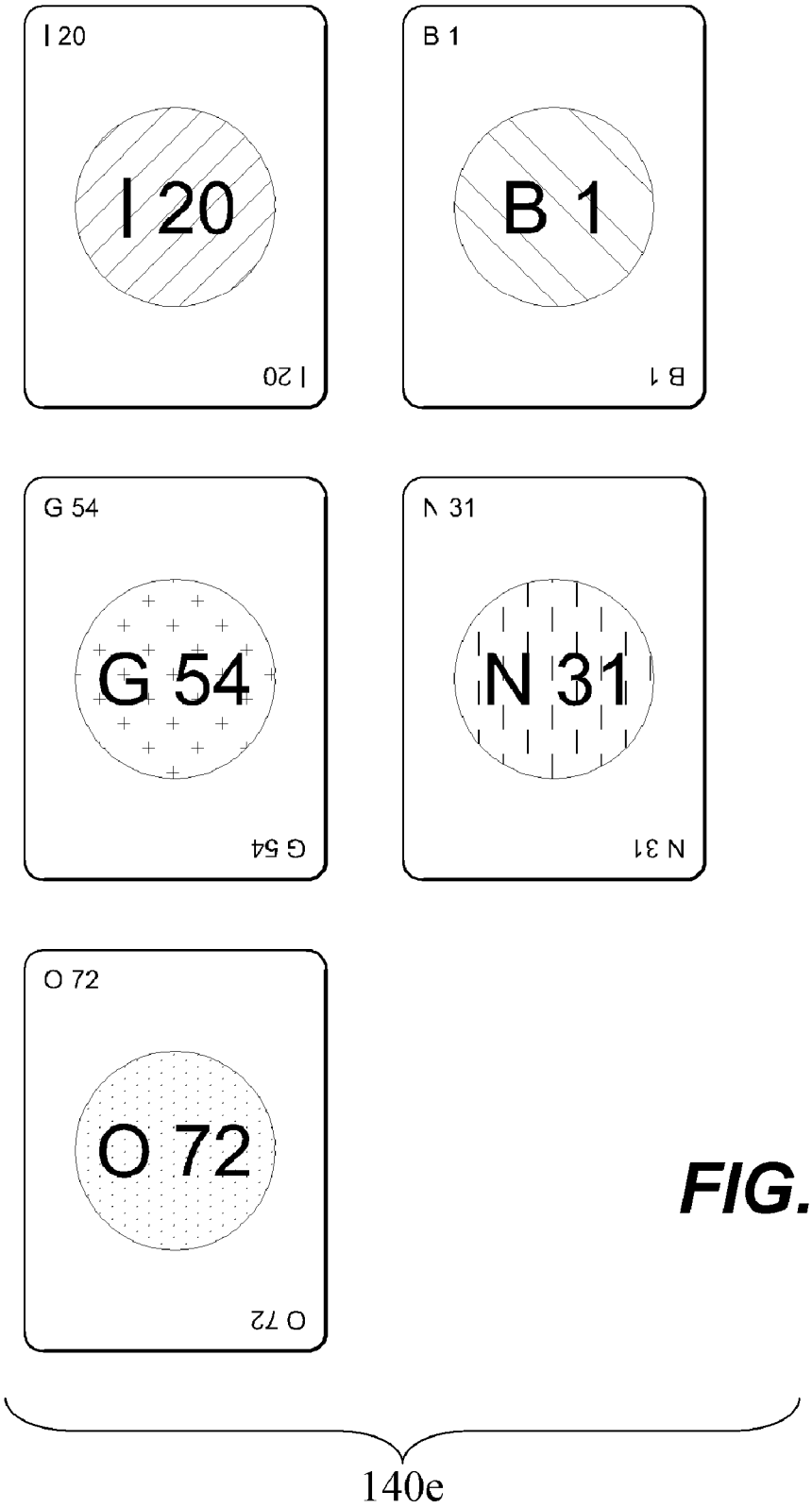
FIG. 11 shows an example selection of cards from a deck of bingo cards according to the present invention.
Figure 12:
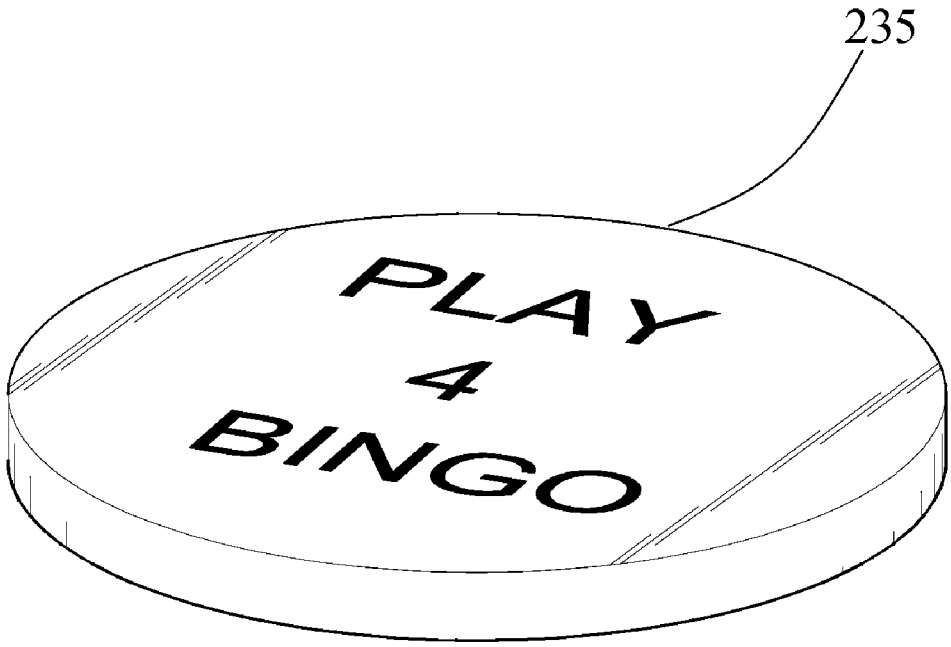
FIG. 12 shows an exemplar bingo chip.

Referring to the Figures in general and FIG. 1 in particular; the table bingo game 100 comprises a bingo table 120 with an optional perimeter lip 125, a deck of bingo cards 140 (examples of which are labeled 140*e* in FIG. 11), and a set of player cards 160 (examples of which are labeled 160*a*, 160*b* . . . 160*f* in FIGS. 5 through 10). The table 120 defines a bingo table surface 180 with a table grid 200 marked out on the table surface 180. While the dealer and players can sit or stand at any location around the bingo table 120 it is preferred, though optional, that the bingo table 120 includes a dealer station 220 and a plurality of player stations 240 are spaced about the periphery of the bingo table 120. The dealer station 220 can include such features as a chip or token rack 230 containing, e.g., one or more chips 235. The player stations can optionally include marked out areas 260 on the bingo table surface 180 for each player to place their bet. The number of cards in the deck of bingo cards 140 can vary, but the preferred number of bingo cards 140 is seventy five.

Figure 4A:
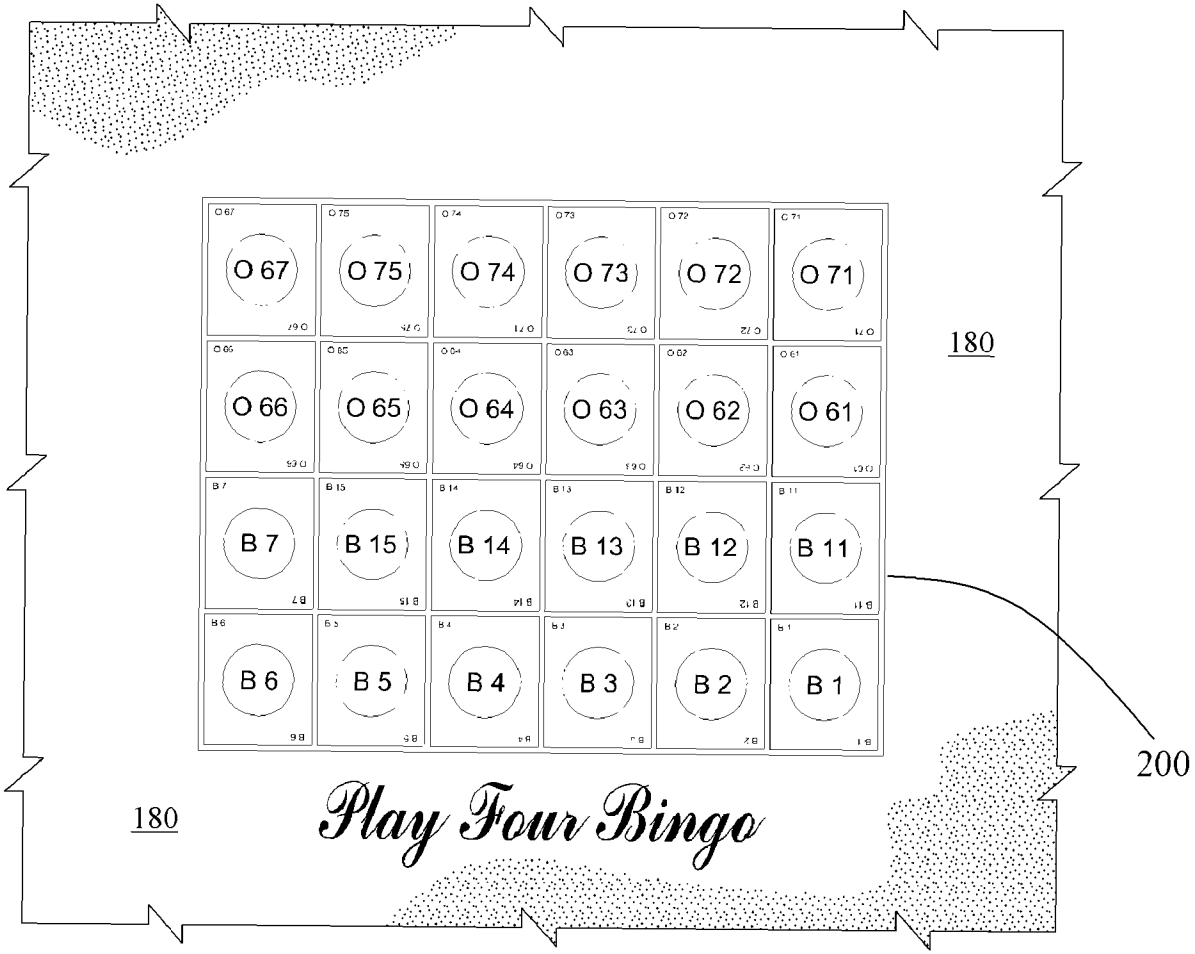
Figure 4B:
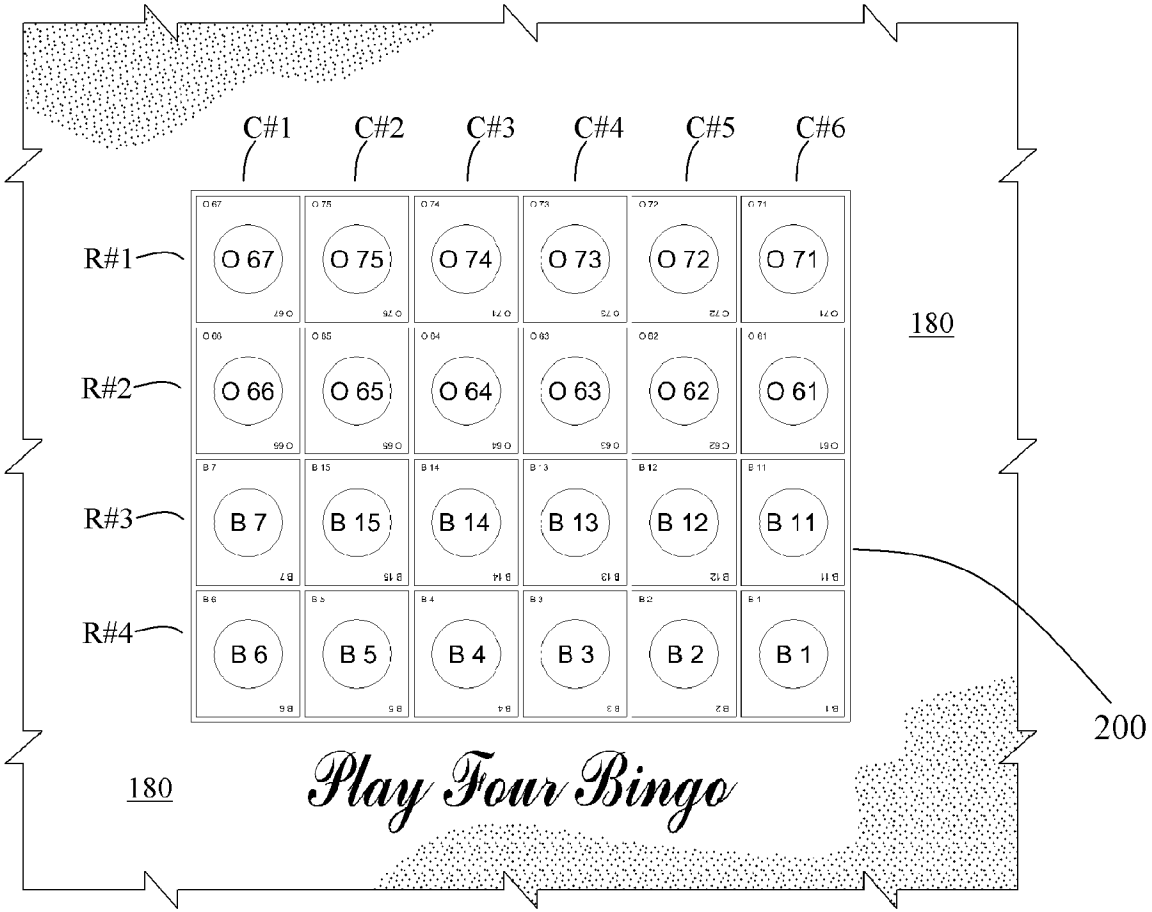
Figure 7:
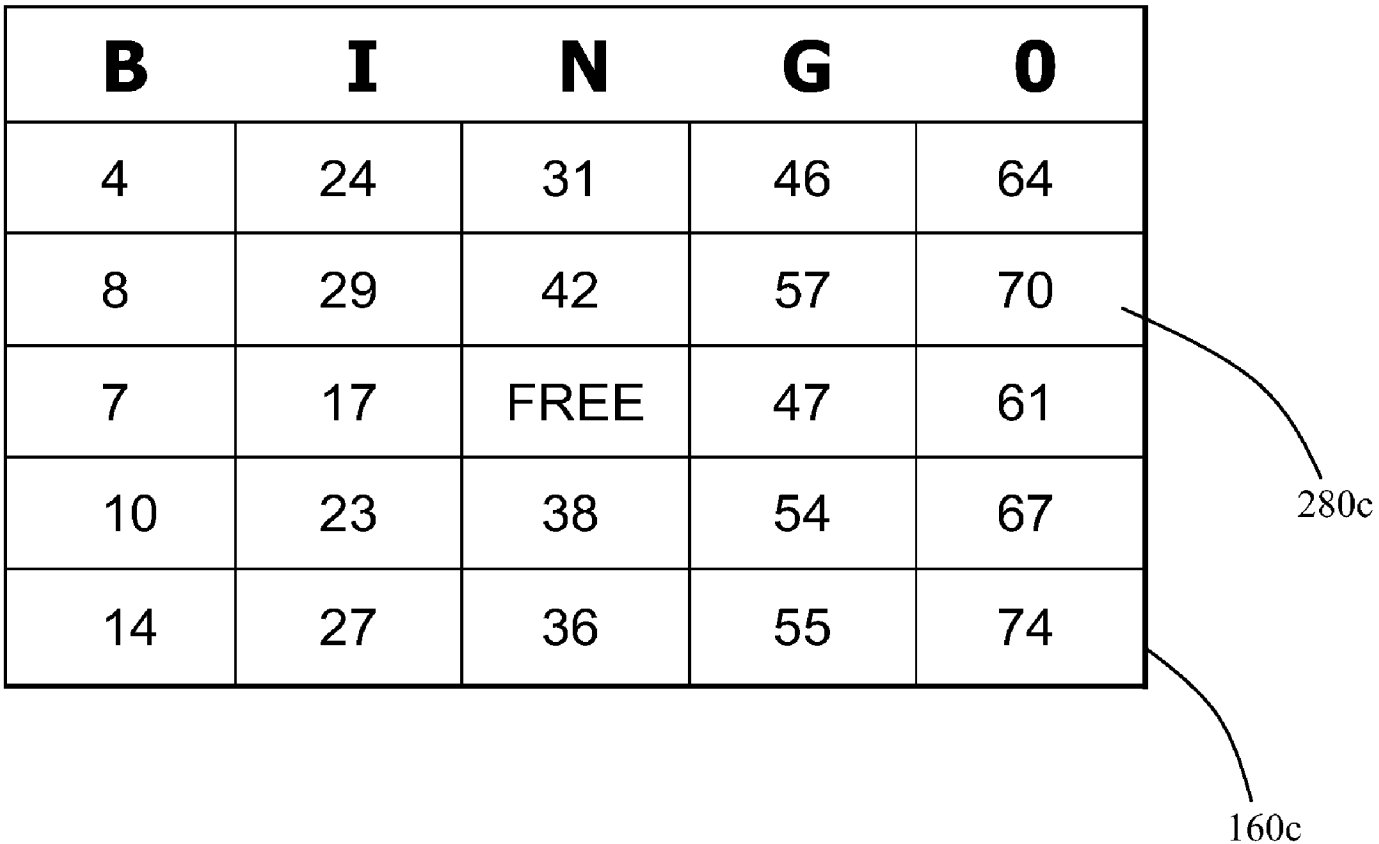
Figure 8:
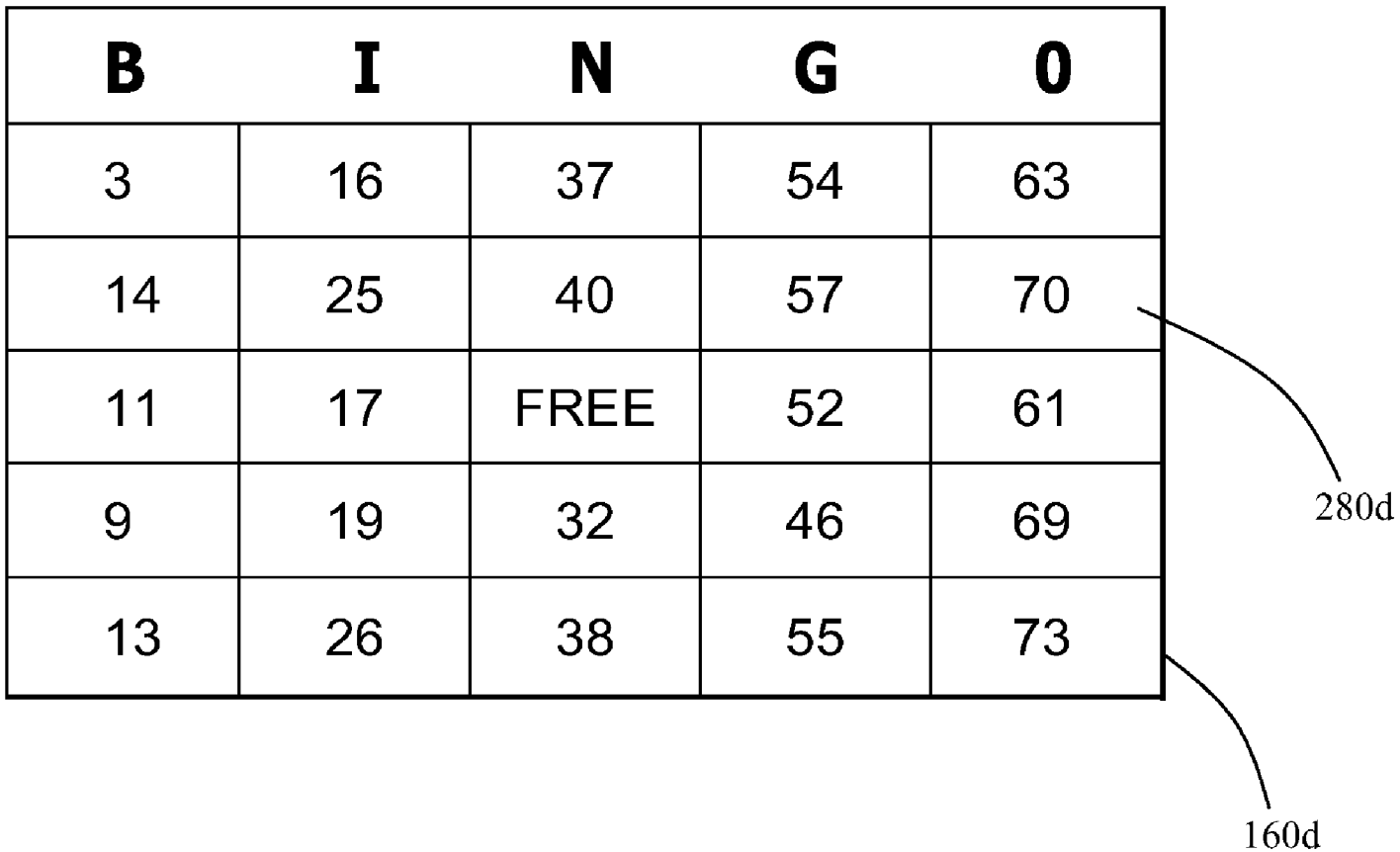
Figure 9:
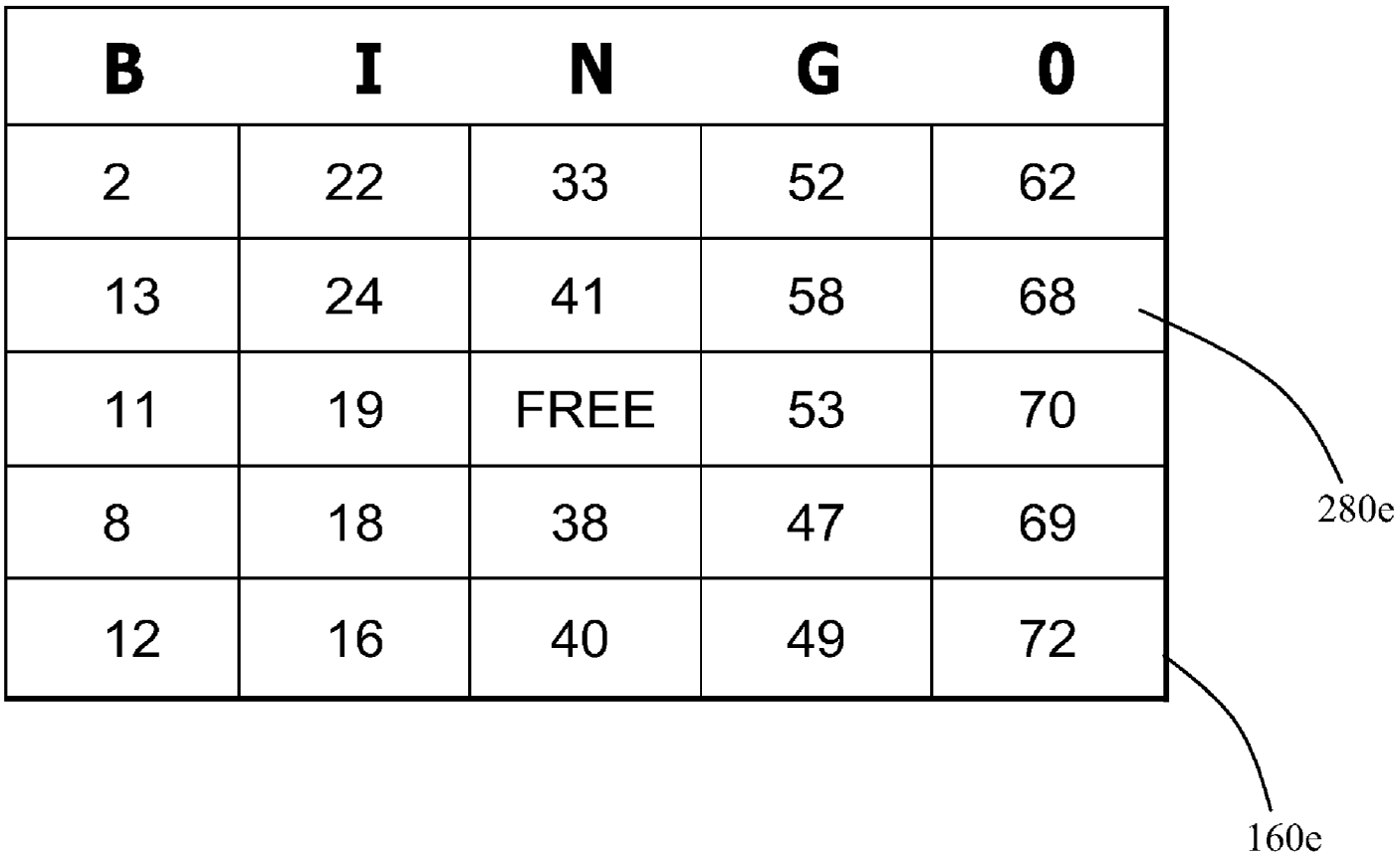
Figure 10:
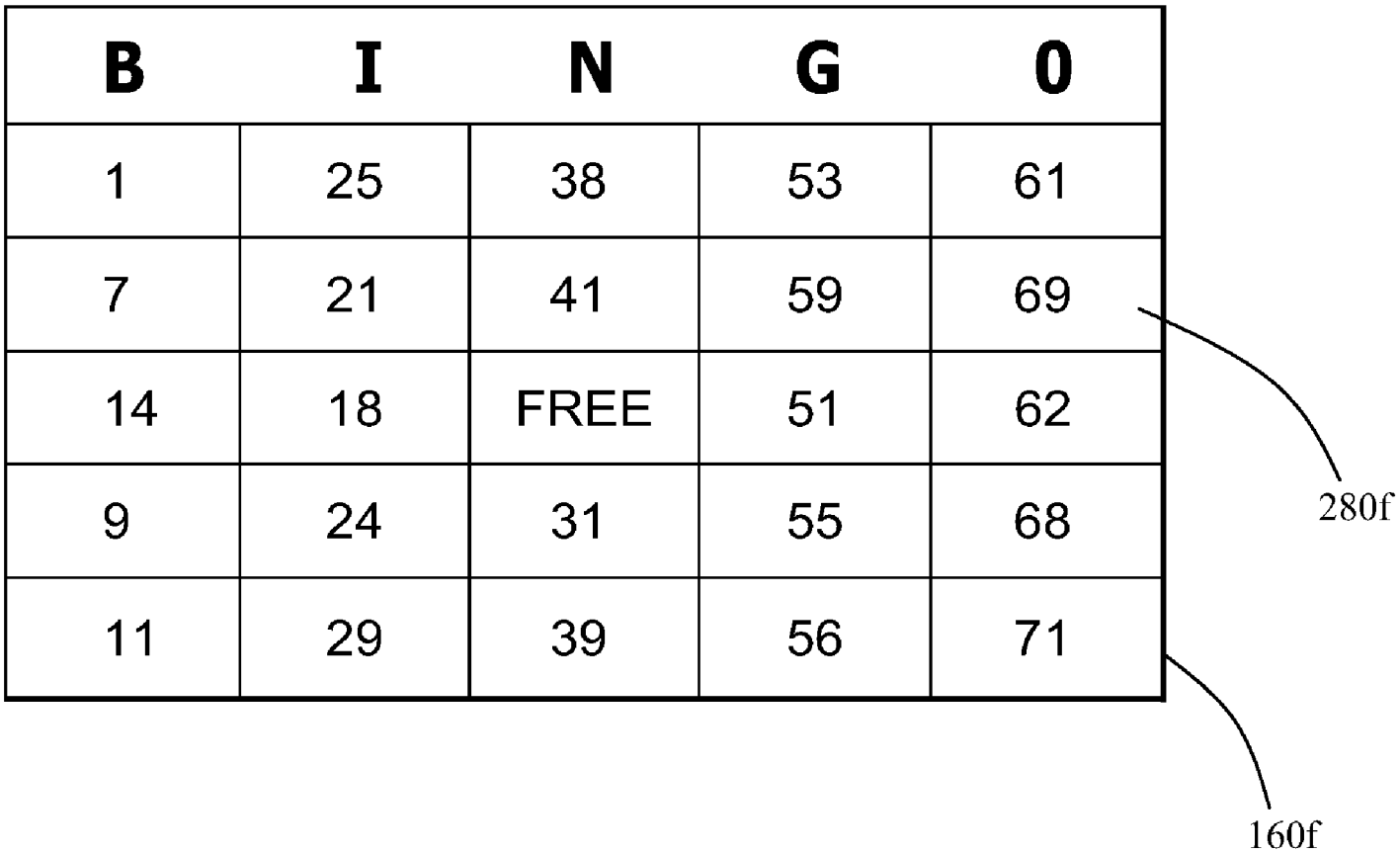

In one non-limiting embodiment, the table grid 200 comprises four rows R#1 through R#4 (see FIG. 4B) and a plurality of columns, wherein the number of columns can vary. The number of columns typically corresponds to the maximum number of players who can play the table bingo game 100 according to the invention. Thus, if there are six columns, then a maximum number of six players can play the game 100 (in FIG. 4B there are six columns labeled as C#1 through C#6). If there are ten columns, then the maximum number of players would be ten. The exception being that columns that are not necessary to play the game 100 will not impact on the number of players that can play the game 100; e.g. columns that are merely decorative will typically not impact on the maximum number of players that can play the game 100.

Bets can be in any suitable form such chips, cash, a magnetic card on which a numeric amount of money is imprinted (e.g., a prepaid betting limit such as $200 prepaid). However, the table bingo game 100 of the present invention can also be played with chips or tokens that represent no monetary value such that the principal object of the table bingo game 100 is entertainment for the players. If bets of monetary value are used in the game, the bet value can be a predetermined value such as $6 per player.

FIGS. 5 through 10 show the player cards 160 (represented by alpha-numeric labels 160*a* through 1600. These player cards correspond to a 4 rows by 6 columns table grid 200, i.e., m=4, and n=6. Each player card 160 comprises a player card grid 280 (represented by alpha-numeric labels 280*a* through 2800. The four corner numbers in card grid 280*a* of player card 160*a* corresponds to the numbers in column #1 in table grid 200, i.e., 67, 66, 7 and 6 (see FIGS. 4B and 5, respectively). The four corner numbers in card grid 280*b* of player card 160*b* corresponds to the numbers in column #2 in table grid 200, i.e., 75, 65, 15, and 5 (see FIGS. 4B and 6, respectively). The four corner numbers in card grid 280*c* of player card 160*c* corresponds to the numbers in column #3 in table grid 200, i.e., 74, 64, 14, and 4 ((see FIGS. 4B and 7, respectively). The four corner numbers in card grid 280*d* of player card 160*d* corresponds to the numbers in column #4 in table grid 200, i.e., 73, 63, 13, and 3 (see FIGS. 4B and 8, respectively). The four corner numbers in card grid 280*e* of player card 160*e* corresponds to the numbers in column #5 in table grid 200, i.e., 72, 62, 12, and 2 (see FIGS. 4B and 9, respectively). The four corner numbers in card grid 280*f* of player card 160*f* corresponds to the numbers in column #6 in table grid 200, i.e., 71, 61, 11, and 1 (see FIGS. 4B and 10, respectively). It should be understood that the numbers shown in table grid 200 can vary, but are not duplicated, but each column in the table grid 200 must correspond to the four corner numbers of one of the player cards 160. Similarly, the four corner numbers of each player card 160 can vary, but must correspond to one of the columns in table grid 200.

In one embodiment of the invention the table grid 200 is made up of m rows and n columns (e.g., 4 rows and 6 columns for a six player game; 4 rows and 7 columns for a seven player game) to provide mn spaces defining an m by n matrix defining a rectangular array of preselected integer numbers therein, wherein each preselected integer number in the m by n matrix has an integer value between 1 and y, the table surface further comprises n player areas to allow between 1 and n players to individually place a predetermined bet on the table, the table surface further defining a dealer area.

In one embodiment of the invention a method of playing a bingo game 100 for one to n players, comprises the steps of:

providing a table 120, the table having a table surface and a table grid marked out on the table surface, wherein the table grid comprises m rows and n columns to provide an m by n matrix defining a rectangular array of preselected numbers therein, wherein each number in the m by n matrix has an integer value between 1 and y;

providing a deck of bingo cards 140 made up of y bingo cards, each of they bingo cards having printed thereon indicia corresponding to an integer number in the range 1 through y;

providing a set of n player cards 160, each of the n player cards having a player grid 280 printed thereon, each of the player grids comprising four corner numbers each of predetermined value in the range 1 through y, wherein for each set of four corner numbers there is a column in the table grid having four matching numbers;

distributing one player card to each player, wherein the number of players is between 1 and n, wherein each player has paid a predetermined amount of money to purchase a player card;

requiring each player to place a bet of predetermined value on the table surface;

playing the game by consecutively selecting bingo cards from the deck of bingo cards and positioning each selected bingo card that matches a number in the grid marked out on the table surface such that a matching bingo card is placed over one of the mn spaces (a bingo card, represented by numeric label "140*a*", is shown in FIG. 1 just placed over one of the grid spaces in grid table grid 200), and for each selected bingo card that does not match any number on the grid marked out on the table surface placing each unmatched card on the table surface but away from the grid marked out on the table surface (unmatched cards are represented by the alpha-numeric label "140*u*" in FIG. 1; and terminating the game upon filling one of the columns in the table grid with four matching bingo cards whereupon the player with the player card with four corner numbers matching the filled grid column wins the game.

It should be understood that the table grid 200 is made up of m rows and n columns, where typically there are four rows (i.e., m has an integer value of 4) and any suitable number of n columns where n corresponds to the maximum number of players. For example, if n equals 6 the maximum number of players that can play is 6. Where n equals 7, the maximum number of players is 7. It should be understood that the term "n columns" refers to columns in the table grid 200 having integer values disposed therein; the integer values in a column corresponding to the integer numbers found on one of the player cards 160, e.g., the four corner numbers found in grid 280 of a player card. While n can have any suitable integer value, the preferred range is 2 through to 20, more preferably 4 through 12, and still more preferably 6 through 10; the most preferred value of n is the integer value of 6 (i.e., n=6 to provide a table grid 200 made up of four rows and six columns, a 4 by 6 matrix). Since the numbers on the grid 200 are not duplicated it follows that there should be a large enough range of integer numbers displayed in the deck of bingo cards 140 to cover the integer numbers disposed in grid 200. Thus, for a 20 player game there would have to be at least 4×20 bingo cards in the deck of bingo cards 140 (i.e., at least 80 bingo cards). For a ten player game at least 4×10 in the deck of bingo cards 140 (i.e., at least 40 bingo cards). For a game 100 with 75 cards in the deck of bingo cards 140 this would be sufficient to accommodate a maximum number of eighteen players, which would mean a bingo table 120 with at least eighteen player stations 240.

FIG. 13 shows a flowchart that shows the show the steps of playing a table bingo game according to the invention. The steps in FIG. 13 are labeled 500 through 640. FIG. 13 is the same as FIG. 14 except that in FIG. 14 the integer value of m is four, and the integer value of n is six as shown in step labeled 520*a*. In FIG. 15 the integer value of m is four, the integer value of n is six, and the integer value of y is 75 as shown in step labeled 520*b*. In FIG. 16 the bets of predetermined value have zero monetary value as shown in step labeled 600*a*.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed:

1. A method of playing a bingo game by one to n players, comprising the steps of:

providing a table, said table having a table surface and a table grid marked out on said table surface, wherein the table grid comprises m rows and n columns to provide an m by n matrix defining mn spaces and further defining a rectangular array of preselected numbers therein, wherein each number in the m by n matrix has an integer value between 1 and y;

providing a deck of bingo cards made up of y bingo cards, each of said y bingo cards having printed thereon indicia corresponding to an integer number in the range 1 through y;

providing a set of n player cards, each of said n player cards having a player grid printed thereon, each of said player grids comprising four corner numbers each of predetermined value in the range 1 through y, wherein for each set of four corner numbers there is a column in said table grid having four matching numbers;

distributing one player card to each player, wherein the number of players is between 1 and n, wherein each player has paid a predetermined amount of money to purchase a player card;

requiring each player to place a bet of predetermined value on said table surface;

playing the game by consecutively selecting bingo cards from said deck of bingo cards and positioning each selected bingo card that matches a number in the grid marked out on the table surface such that a matching bingo card is placed over one of said mn spaces, and for each selected bingo card that does not match any number on the grid marked out on the table surface placing each unmatched card on said table surface but away from the grid marked out on the table surface; and terminating the game upon filling one of said columns in said table grid with four matching bingo cards whereupon the player with the player card with four corner numbers matching the filled grid column wins the game.

2. The method of playing a bingo game according to claim 1, wherein the integer value of m is four, and the integer value of n is six.

3. The method of playing a bingo game according to claim 1, wherein the integer value of m is four, the integer value of n is six, and the integer value of y is 75.

4. The method of playing a bingo game according to claim 1, wherein the bets of predetermined value have zero monetary value.

* * * * *